United States Patent [19]

Spottiswoode et al.

[11] 4,103,172

[45] Jul. 25, 1978

[54] NUCLEAR LIGHT SOURCE

[75] Inventors: Nigel Lawrence Spottiswoode, Bala, Wales; David John Ryden, Nr. Wantage, England

[73] Assignee: AGA Navigation Aids Ltd., United Kingdom

[21] Appl. No.: 670,688

[22] Filed: Mar. 26, 1976

[30] Foreign Application Priority Data

Mar. 26, 1975 [GB] United Kingdom ..... 12661/75

[51] Int. Cl.[2] ..... F21K 2/02

[52] U.S. Cl. ..... 250/462; 250/493

[58] Field of Search ..... 250/462, 493

[56] References Cited

U.S. PATENT DOCUMENTS 3,451,641 6/1969 Leventhal ..... 250/493 X 3,578,973 5/1971 Dooley et al. ..... 250/462

3,621,261 11/1971 Princiotta et al. ..... 250/493

*Primary Examiner*—Archie R. Borchelt

*Attorney, Agent, or Firm*—Weingarten, Maxham & Schurgin

[57] ABSTRACT

The invention relates to light sources and, in particular, to light sources for use in navigational aids such as lighthouses and lighted buoys.

In more detail, the light source of the present invention comprises a radio isotope fuel source, thermal insulation against heat loss, a biological shield against the escape of ionizing radiation, a material having a surface which attains incandescence when subject to isotope decay heat and means for transferring energy from the insulated fuel source to produce incandescence of the surface and thereby emit light.

31 Claims, 2 Drawing Figures

NUCLEAR LIGHT SOURCE

This invention relates to light sources and, in particular, to light sources for use in navigational aids such as lighthouses and lighted buoys. Hitherto acetylene and more recently electric light sources have been used for such purposes.

It is an object of the present invention to provide a light source which will require minimum attention such as servicing and thus, at least in those lighthouse installations which are not required to maintain other services, for example fog signals and radio direction finding signals, reduce the cost of manning such installations.

According to this invention a light source comprises a radio isotope fuel source, thermal insulation against heat loss, a biological shield against the escape of ionizing radiation, a material having a surface which attains incandescence when subject to isotope decay heat and means for transferring energy from the insulated fuel source to produce incandescence of the surface and thereby emit light.

Conveniently, the surface which is subject to isotope decay heat is cylindrical and has an associated filter permitting a relatively high transmission of radiation from the fuel source in the visible spectrum and a relatively high reflectance in the infra-red spectrum.

Since the power densities of radio-isotope fuels are not large, it is desirable to surround the fuel with thermal insulation except for a small area which is allowed to radiate. It is also desirable to shield the fuel source to prevent the escape of ionizing radiation and prevision should, therefore, be made for energy to pass through the shield either in the form of heat or light, unaccompanied by harmful radiation. Thus the incandescent surface may lie within the biological shield or external to it.

If the incandescent surface lies within the biological shield, the light transfer to the outside could be achieved using a reflection system comprising a tube, the inner surface of which is polished metal having a high specular reflectivity. Since the tube would preferably be bent to prevent a direct "shine" from the fuel source, the tube is preferably made of "D" shaped cross-section. Another method includes the use of lead glass which could constitute part of the gamma shield per se or form part of a lens focussing system.

If the incandescent surface is external to the biological shield, then heat transfer may be achieved by an insulated rod of tungsten which would also serve as part of the biological shield. In cases where a neutron emitting isotope is used as the fuel source, the tungsten rod should be bent in order to avoid a direct path for neutrons.

The preferred method for transferring heat through the biological shield to an external incandescent surface is, however, a heat pipe or reflux condenser. A tungsten heat pipe using silver as the working fluid is particularly suitable. Heat pipes and reflux condensers include an inherent property which may be used to overcome isotope fuel decay problems where, if the heat reaches the incandescent surface by direct conduction, the temperature and the radiating efficiency would fall as the isotope fuel energy decays. This can be overcome by introducing into the working fluid of the heat pipe a quantity of noncondensible gas of low solubility so that, in a steady state, the gas is driven to the terminal end of the condenser where it forms a stagnant zone. In operation, when the heat flux along the heat pipe decreases due to isotope decay, the working fluid (silver) vapour pressure falls causing the liquid metal/inert gas interface to recede down the heat pipe. Thus, the height of the light source (usually vertically disposed) decreases as the available isotope energy decreases. Considered slightly differently, by this means it is possible to reduce the surface area of the incandescent surface as the isotope decays to maintain the temperature and also the luminous efficiency (as hereinafter defined) constant.

BRIEF DESCRIPTION OF THE DRAWING

The advantages, features and objects of this invention will be clearly understood from the following detailed description when taken in conjunction with the accompanying drawing in which.

DESCRIPTION OF THE PREFERRED EMBODIMENTS

Encapsulated isotope fuel sources which may be used in a light source according to the present invention include strontium 90 titanate ($^{90}SrTiO_3$), strontium 90 ($^{90}Sr$), curium 244 sesquioxide ($^{244}Cm_2O_3$), cobalt fuel forms, for example, $^{60}Co$, the oxide CoO-MoO, cobalt aluminate ($CoAl_2O_4$), cobalt compounds and alloys such as Co-Re alloys, plutonia $^{238}PuO_2$ and cermet fuels comprising oxide fuel powders or microspheres contained in a metal matrix. The fuel encapsulant used will, of course, depend upon the isotope fuel source employed.

Desirable characteristics of isotope fuel sources for use as the light source are: low cost per thermal watt, compatibility with encapsulation, reasonable power density, reasonably long half life, low biological hazard and reasonable availability.

Dealing with certain of the isotope fuels mentioned above: $^{90}SrTiO_3$ has a half life of 28 years, is compatible with refractory metal encapsulation at 1850° C., possesses a relatively low power density of the order of 0.85 watts/cm$^3$.

$^{244}CmO_3$ has a half life of 18 years, requires light to moderate shielding against gamma emission and has a relatively high power density of the order of 27 watts/cm$^3$. Furthermore, it is compatible with refractory metal encapsulation at 2000° C. However, shielding against neutrons is also required.

Cobalt fuel forms can possess power densities up to 156 watts/cm$^3$ for pure $^{60}Co$ but typical values of the order of 15 watts/cm$^3$ are more usual. Cobalt fuel forms are compatible with encapsulated materials at temperatures in the region of 1850° C., but possess a somewhat short half life of 5.3 years. Further, since $^{60}Co$ decays by gamma emission, the sources should preferably be large or be subjected to secondary shielding in order to convert gamma photon energy to heat.

Of the other isotope fuels referred to above, $^{238}PuO_2$ has a very long half life, namely 89 years, has a good power density of 4.5 watts/cm$^3$ and it requires little or no shielding. Thus, in installations where weight is an important consideration, $^{238}PuO_3$ is useful because negligible shielding is required.

Most isotope fuels, other than a Co-Re alloy, possess low thermal conductivities so that very large temperatures could develop within the interior of such fuels. Acceptable temperature differences within normally high temperature fuels may be achieved by particular design of the fuel source or by use of a cermet type fuel.

Figure 1:
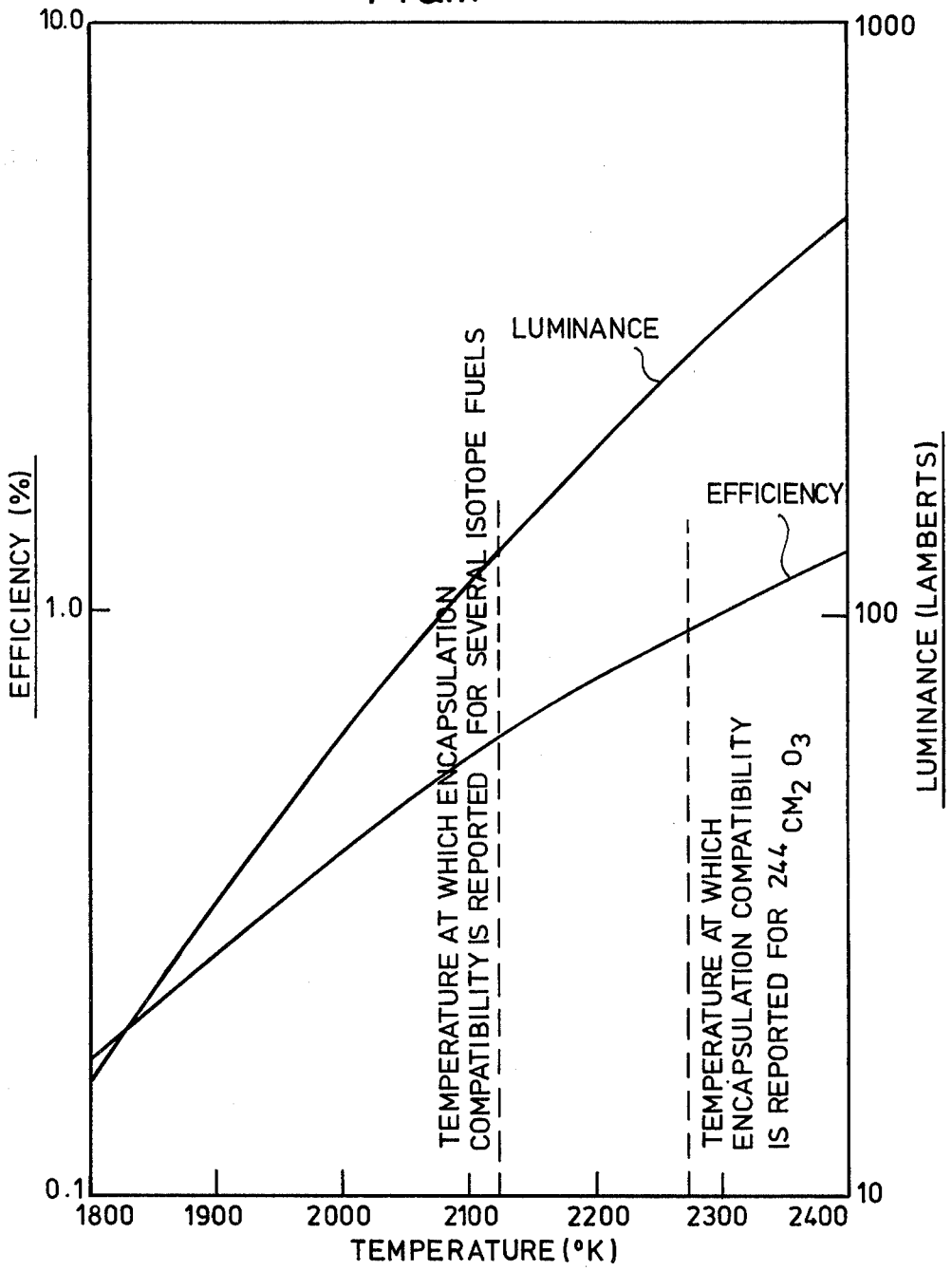
FIG. 1 is a graph showing the relationship between luminous efficiency and the brightness of a tungsten surface as a function of absolute temperature.

The incandescent material is preferably tungsten, tantalum, or molybdenum. Tungsten rhenium alloys may also be used. In any light source it is desirable for the incandescent surface to emit as high a fraction of the available energy or power in the visible region of the spectrum as possible. Thus, an incandescent surface having a low overall emissivity should be used so that the temperature reached for a given power radiated is high. This increases the visible radiation at the expense of the infra red radiation. Further, the emissivity in the visible spectrum should be high compared with that of the infra red spectrum, thereby transferring more of the radiation into the visible spectrum. FIG. 1 of the accompanying drawings is a graph showing the relationship between the luminous efficiency (as hereinafter defined) and the brightness of a tungsten incandescent surface as a function of absolute temperature.

The term "luminous efficiency" used in this specification is defined in terms of the response of the human eye, that is, the number of lumens produced for each watt of energy expended. Alternatively, since 1 watt of radiation at a wave length of 5500 A (that is the peak sensitivity of the eye) is equivalent to 682 lumens, the luminous efficiency may be considered as a percentage on a scale where 682 lumens/watt is 100% efficiency.

Preferably, the incandescent and radiating surface should be protected by an envelope of glass, silica or other suitable material. If desired, the envelope may be filled with an inert gas so as to reduce evaporation and, consequently, the envelope should be adequately sealed.

The efficiency of light emission can be improved by means of a filter associated, as mentioned previously, with the fuel source. Suitable filters include electrically conductive coatings of, for example, tin oxide on glass or tin doped indium oxide. Other filters include non-metallic multi-layer interference filters which have the advantage that they are non-absorbing for wave lengths greater that 0.4 $\mu$ so that the Reflectance $R = 1-T$ where T is the transmission of the filter and in this case is 80–95% in the visible spectrum falling to approximately 15% to beyond 0.8 $\mu$. Use of such a filter permits 70% of the tungsten radiation to be returned to the incandescent surface with a 15% drop in illumination. By this means the efficiency may be more than doubled.

In order that a high proportion of the heat generated by the isotope fuel source is transmitted to and radiated from the incandescent surface, the fuel source is thermally insulated. One particularly effective thermal insulation comprises a plurality of metal foils supported in spaced relationship. The spaces between adjacent foils may contain a refractory insulation material such as a refractory oxide. The insulation is preferably operated in a vacuum of the order of, for example, $10^{-5}$mm. Hg. Getter materials for maintaining the desired vacuum include barium, magnesium, aluminium and a number of commercially produced alloys.

One particular foil-oxide combination comprises tungsten or tungsten-rhenium alloy- foil sheets separated by thoria. If desired, the tungsten foil on the cold side may be replaced by tantalum which has an advantage over tungsten owing to its greater ease of fabrication.

It has been found that the heat flux through such multifoil insulation is inversely proportional to the number of foils and proportional to the fourth power of the hot side temperature in degrees absolute.

Figure 2:
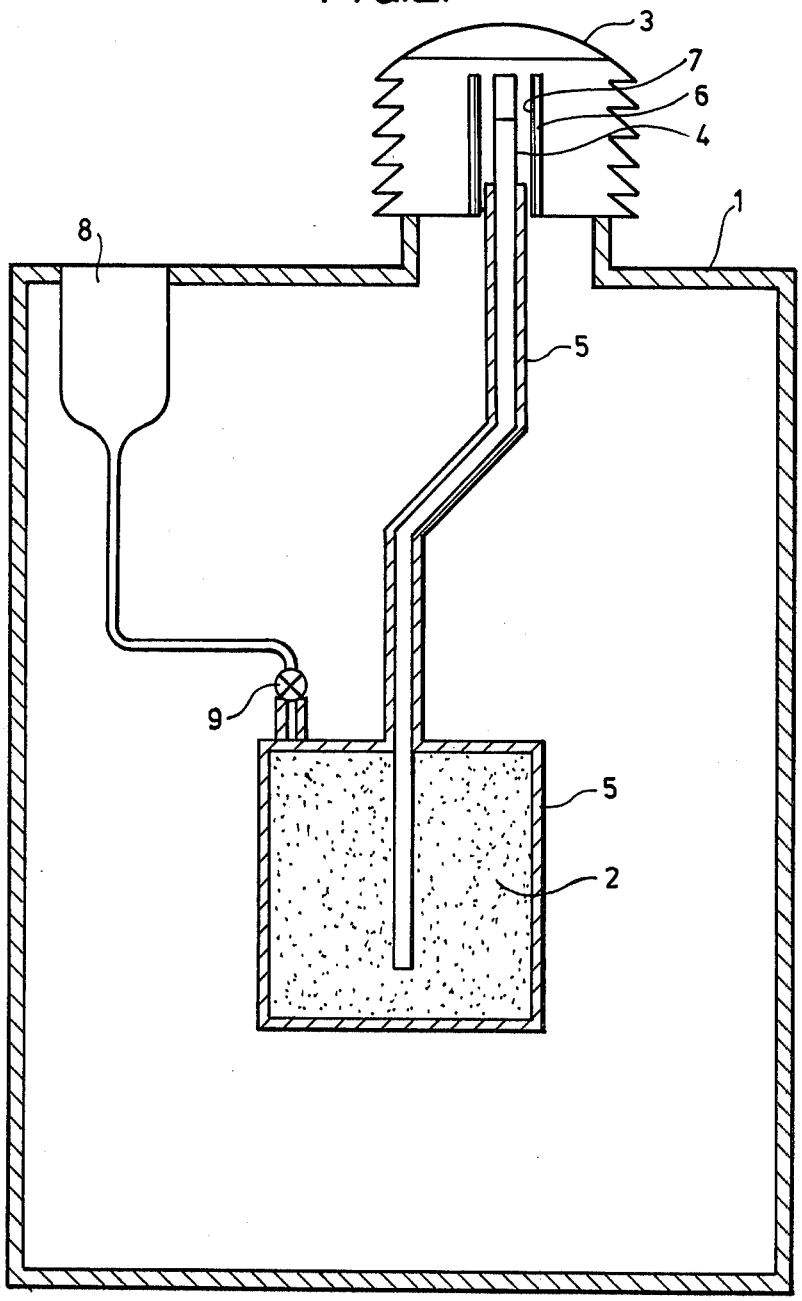
FIG. 2 is a cross-sectional view of a light source constructed in accordance with the present invention.

One form of light source in accordance with the invention is shown by way of example in FIG. 2 which is labelled and, in view of the foregoing description, the construction thereof is self-explanatory.

The light source of FIG. 2 has a biological shield 1 enclosing an isotope fuel source 2 which is connected to a lamp housing 3 via a bent tungsten heat pipe 4. The heat pipe 4 and the isotope fuel source 2 are insulated with multifoil insulation 5. The heat pipe 4 contains, as mentioned previously, silver as the working fluid and at the upper end thereof a quantity of inert gas (a non-condensible gas of low solubility) so that, in operation and in a steady state, the gas forms a stagnant zone at the terminal upper end of the heat pipe.

A cylindrical infra red filter is disposed around the terminal end of the heat pipe and has on its inner surface a layer of material 7 which attains incandescence when subject to isotope decay heat transmitted thereto via the insulated heat pipe 4.

The multifoil insulation 5 is supplied as indicated with inert gas from a source 8 via a safety valve 9 to reduce the possibility of temperature excursions and outgassing of the insulation as described later.

It will be appreciated that temperature excursions with the isotope fuel source should be reduced as much as possible and, preferably, avoided. Small temperature excursions may be avoided by ensuring that the multifoil insulation 5 is never outgassed at temperatures higher than the temperature of operation. Since the insulation 5 is operated in a vacuum, any increase in temperature will lead to outgassing from the insulation and a resulting increase in the thermal conductivity. The insulation 5 would, however, recover as the gas is absorbed by the getter. An alternative method for controlling temperature excursions is by means of a second inert gas-containing heat pipe which would allow heat transfer from a finned radiator in the event of a rise in the temperature of the fuel source.

Temperature rises may also be prevented or at least reduced by allowing a gas to enter the insulation if the temperature rises above a predetermined level.

To this end the normally closed valve 9 would be controlled with a temperature sensitive fail safe device and located in a supply line between a gas reservoir 8 to the vacuum enclosed or sealed multifoil 5. The fail safe device could open, for example, by means of a membrane which would melt or otherwise fracture at the predetermined temperature or by thermal expansion. Large temperature rises leading to failure, as for example, if the incandescent surface became completely obscured or if the heat pipe or other fuel energy transmission unit failed, could be overcome by using an inert gas which cannot be pumped by the getter or by ensuring that the reservoir contains more gas than that which can be absorbed by the getter in the multifoil insulation. It may also be desirable from a safety point of view to ensure that gas is let into the insulation vacuum encloser if the light source receives a violent impact.

It will be appreciated that light produced by a light source according to the present invention in a lighthouse, is wasted during daylight hours and in order to harness what would otherwise be wasted light, a lighthouse may be equipped with one or more solar cells and power therefrom could be stored in a battery, the energy of which could be used to provide rotation of the light source or a flashing unit during hours of darkness.

What we claim is:

1. A light source comprising:
a radio isotope fuel source;
thermal insulation against heat loss surrounding said fuel source;
a biological shield against the escape of ionizing radiation surrounding said fuel source and said thermal insulation;
a material having a surface which attains incandescence when subject to isotope decay heat;
means for transferring energy from said insulated fuel source to produce incandescence of said surface and thereby emit light; and
a filter associated with said surface permitting a relatively high transmission of radiation from the fuel source in the visible spectrum and a relatively high reflectance in the infra red spectrum thereby increasing the luminous efficiency of said light source.

2. A light source according to claim 1, wherein the surface which is subject to isotope decay heat is cylindrical.

3. A light source comprising:
a radio isotope fuel source;
thermal insulation against heat loss surrounding said fuel source;
a biological shield against the escape of ionizing radiation surrounding said fuel source and said thermal insulation;
a material having a surface which attains incandescence when subject to isotope decay heat;
means for transferring energy from said insulated fuel source to produce incandescence of said surface and thereby emit light; and
a noncondensable gas in said energy transferring means to maintain the temperature and the luminous efficiency of the light source substantially constant as the isotope decays.

4. A light source according to claim 1 wherein said thermal insulation surrounding said fuel source is formed with a relatively small opening to permit radiation to pass therethrough.

5. A light source according to claim 1 and further comprising means for permitting energy to pass through said biological shield to said surface which attains incandescence when subjected to the energy.

6. A light source according to claim 5, wherein said surface is disposed within said biological shield.

7. A light source according to claim 5 wherein said surface is disposed external to said biological shield.

8. A light source according to claim 6 and further comprising a reflection system for transmitting light from said surface through said biological shield.

9. A light source according to claim 8, wherein said reflection system comprises a tubular member having an inner surface made from a metallic material, said inner surface possessing high specular reflectivity.

10. A light source according to claim 9, wherein said tubular member is of "D"-shaped cross-section.

11. A light source according to claim 9, wherein said tube is bent to prevent direct shine from said fuel source.

12. A light source according to claim 8, wherein said reflection system is made from lead glass.

13. A light source according to claim 7 wherein said energy transferring means comprises an insulated rod of a metallic material for transmitting heat from said source through said biological shield.

14. A light source according to claim 13, wherein said insulated rod constitutes a part of said biological shield.

15. A light source according to claim 13 wherein said rod is made from tungsten.

16. A light source according to claim 13 wherein, in the case of neutron emitting isotope fuel source, said rod is bent to minimise the existence of a direct path for the neutrons.

17. A light source according to claim 1 wherein said means for transferring energy is a heat pipe.

18. A light source according to claim 17, wherein said heat pipe comprises a pipe made from tungsten and containing silver as a working fluid.

19. A light source according to claim 1 wherein said incandescent surface is disposed within an envelope made from glass or silica.

20. A light source according to claim 19, wherein the envelope is filled with an inert gas.

21. A light source according to claim 1 wherein said incandescent material is selected from the group consisting of tungsten, tantalum and molybdenum.

22. A light source according to claim 21, wherein said isotope fuel source is selected from the group consisting of strontium 90 titanate ($^{90}SrTiO_3$), strontium 90 ($^{90}Sr$), curium 244 sesquioxide ($^{244}Cm_2O_3$) and cobalt fuel forms.

23. A light source according to claim 22, wherein said cobalt fuel forms are selected from the group consisting of $^{60}Co$, the oxide CoO-MoO, cobalt aluminate ($CoAl_2O_4$), cobalt compounds and alloys including Co-Re alloys and plutonia $^{238}PuO_2$.

24. A light source according to claim 1 wherein said fuel source is a cermet fuel comprising an oxide fuel powder.

25. A light source according to claim 1 wherein said means for transferring energy is a reflux condenser.

26. A light source according to claim 1 wherein said fuel source is a cermet fuel comprising microspheres contained in a metal matrix.

27. A light source according to claim 1 wherein said thermal insulation comprises multifoil insulation.

28. A light source according to claim 27 wherein said multifoil insulation is maintained under a vacuum.

29. A light source according to claim 27 and further comprising:
a source of inert gas;
conduit means to convey said inert gas to said multifoil insulation; and
a safety valve in said conduit means;
whereby the possibility of temperature excursions and outgassing of said multifoil insulation is reduced.

30. A light source according to claim 27 and further comprising:
a source of inert gas;
conduit means coupling said source of inert gas to said multifoil insulation; and
a normally closed safety valve in said conduit means;
said multifoil insulation being maintained in a vacuum, said safety valve being automatically opened under emergency conditions to supply said inert gas to said multifoil insulation.

31. A light source according to claim 13 wherein:
said thermal insulation comprises a multifoil insulation;
said multifoil insulation also insulates said rod of metallic material.

* * * * *

UNITED STATES PATENT AND TRADEMARK OFFICE

CERTIFICATE OF CORRECTION

PATENT NO. : 4,103,172

DATED : July 25, 1978

INVENTOR(S) : Nigel Lawrence Spottiswoode et al

It is certified that error appears in the above-identified patent and that said Letters Patent are hereby corrected as shown below:

Column 1, line 33, "prevision" should read --provision--; and
line 48, "per se" should read --per se--.

Column 5, line 24, "the" should read --said--.

Column 6, line 19, "the" should read --said--.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*